United States Patent [19]

Dols

[11] Patent Number: 4,541,404

[45] Date of Patent: Sep. 17, 1985

[54] TILE CUTTING APPARATUS

[76] Inventor: Robert H. Dols, 18 Milan St., Mentone, Victoria, Australia, 3189

[21] Appl. No.: 552,049

[22] PCT Filed: Mar. 2, 1983

[86] PCT No.: PCT/AU83/00029

§ 371 Date: Oct. 26, 1983

§ 102(e) Date: Oct. 26, 1983

[87] PCT Pub. No.: WO83/03073

PCT Pub. Date: Sep. 15, 1983

[30] Foreign Application Priority Data

Mar. 3, 1982 [AU] Australia ..... PF3000

[51] Int. Cl.[4] ..... B28D 1/04

[52] U.S. Cl. ..... 125/14; 83/574

[58] Field of Search ..... 51/34 C, 48 HE; 125/13, 125/14; 83/574, 485

[56] References Cited

U.S. PATENT DOCUMENTS

| | | | |
|---|---|---|---|
| 1,646,589 | 10/1927 | Meek | 83/574 |
| 2,562,578 | 7/1951 | Rickman | 51/48 HE |
| 2,812,786 | 11/1957 | Hayes . | |
| 3,323,507 | 6/1967 | Schuman | 125/14 |
| 3,815,570 | 6/1974 | Story | 125/14 |

FOREIGN PATENT DOCUMENTS

| | | |
|---|---|---|
| 827113 | 1/1952 | Fed. Rep. of Germany . |
| 379106 | 8/1964 | Fed. Rep. of Germany . |
| 726629 | 6/1932 | France . |
| 1498282 | 9/1967 | France . |
| 465728 | 5/1937 | United Kingdom . |
| 788064 | 12/1957 | United Kingdom . |
| 932417 | 7/1963 | United Kingdom . |

*Primary Examiner*—Harold D. Whitehead

*Attorney, Agent, or Firm*—Scully, Scott, Murphy and Presser

[57] ABSTRACT

Tile cutting apparatus having a work table to support a tile and support means for a cut-off saw, wherein the support means comprises a cantilever arm extending upwardly from one side of the table and then across part of the table, the arm being mounted on a carriage running in a downwardly facing track beneath the table.

14 Claims, 3 Drawing Figures

TILE CUTTING APPARATUS

BACKGROUND OF THE INVENTION

This invention relates to tile cutting apparatus and has been devised particularly though not solely for the cutting of wall and floor tiles.

In the past wall and floor tiles which have required to be cut for example for edge or corner applications have either been cut by hand using a hammer and chisel which is inaccurate and does not leave a neat edge or by using a power saw such as a cut-off saw provided with a suitable cutting blade which may for example be a diamond tipped blade. It is a disadvantage when using a power actuated cut-off saw that it is difficult to accurately hold the tile and guide the saw and although various attempts have been made to provide suitable saw guides they are generally cumbersome in nature and difficult to set up and use. It is a problem with the design of such saws that due to the cooling water which must constantly be supplied to the diamond cutting blade, the saw guide can quickly become clogged and rendered inoperative through the grit particles carried by the cooling water.

SUMMARY OF THE INVENTION

It is therefore an object of the present invention to provide tile cutting apparatus which will obviate or minimize the foregoing disadvantages in a simple yet effective manner or which will at least provide the public with a useful choice.

Accordingly the invention may broadly be said to consist in tile cutting apparatus comprising a work table adapted to support a tile to be cut, a guide and support track located beneath and/or to one side of the top of the work table and parallel to said one side thereof, a carriage guided and supported by the track, and a cut-off saw supported at a predetermined height above the table by a cantilevered arm extending from the carriage upwardly to said one side of the table and then transversely above the table to the cut-off saw.

Preferably said track is located beneath the top of the work table.

Preferably said track comprises two mutually opposed sideways facing grooves engageable with wheels on said carriage.

Preferably said carriage incorporates three wheels each running on a vertical axle and wherein two said wheels are spaced apart and engaged with a groove on one side of said track and the third said wheel is located between said first two wheels and engageable with the groove in the other side of said track.

Preferably said third wheel is mounted on an axle adjustable towards and away from the other two wheels to compensate for any wear in the track or wheels.

Preferably said cantilevered arm includes a vertical portion extending upwardly from the carriage, said vertical portion being adjustable for height so as to adjust the height of the cut-off saw above the table top.

Preferably said cantilevered arm includes a horizontal portion extending transversely above the table, said horizontal portion being pivotally mounted to said vertical portion so that the horizontal portion and hence the cut-off saw may be tilted upwardly away from the table top and then lowered downwardly in a similar fashion for pocket cutting into the surface of a tile.

Preferably said table top is provided in two portions there being a fixed level portion and a hinged portion fastened to the fixed portion by way of one or more hinged pins and tiltable downwardly at a predetermined angle so that a tile placed on and supported by the tilted portion may be cut by the blade of the cut-off saw at said predetermined angle.

Preferably said table top is provided with an upstanding fence edge for location of a tile to be cut and with an adjustable fence to enable a tile to be cut on a predetermined angle.

BRIEF DESCRIPTION OF THE DRAWINGS

Notwithstanding any other forms that may fall within its scope one preferred form of the invention will now be described by way of example only with reference to the accompanying drawings in which.

DETAILED DESCRIPTION OF THE PREFERRED EMBODIMENTS

In the preferred form of the invention tile cutting apparatus particularly suitable to be used for the cutting of floor and wall tiles in conjunction with a circular saw incorporating a diamond cutting blade is constructed as follows.

The apparatus comprises a work table having a table top 1 supported by legs 2 from a base frame 3 which may be placed upon any suitable support surface such as a floor or workbench.

Figure 1:
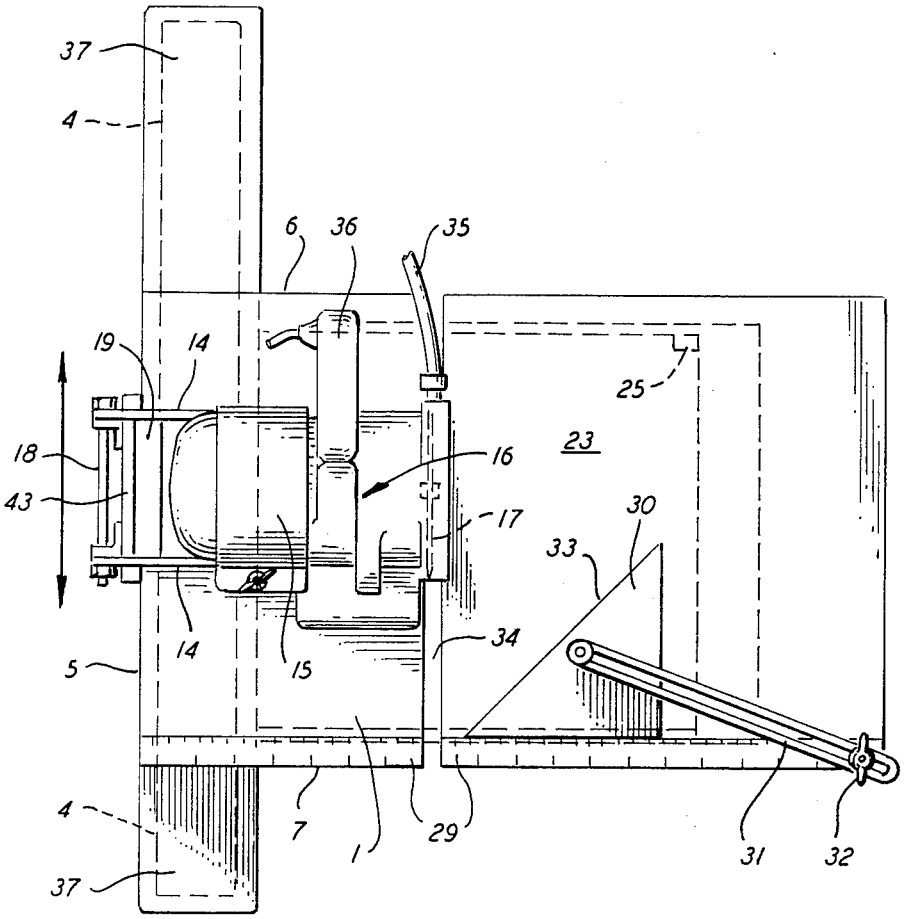
FIG. 1 is a plan view of tile cutting apparatus according to the invention.
Figure 2:
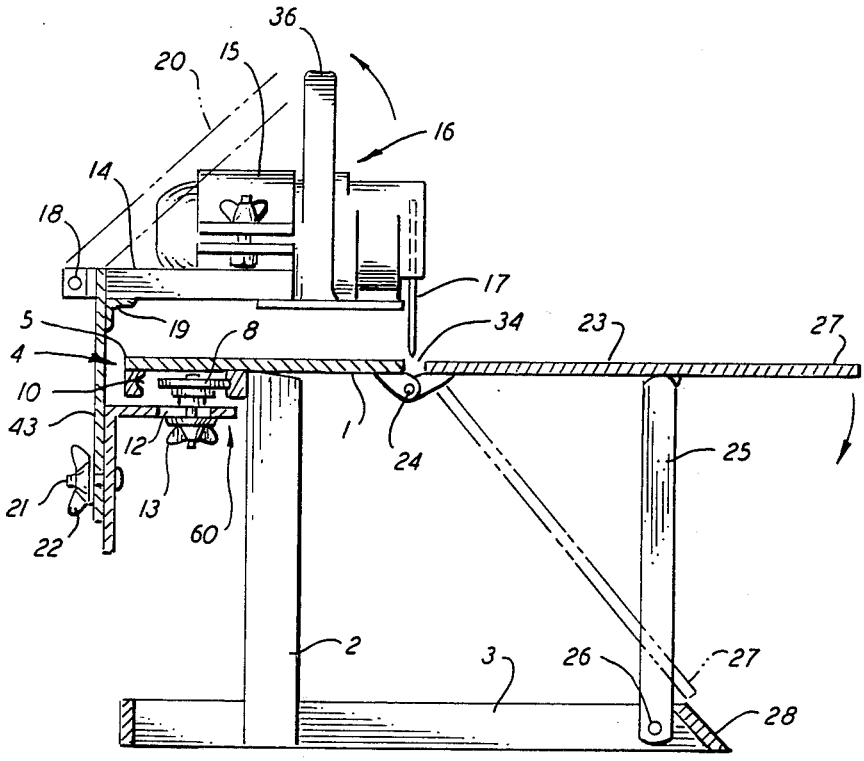
FIG. 2 is a frontal view of the tile cutting apparatus shown in FIG. 1.
Figure 3:
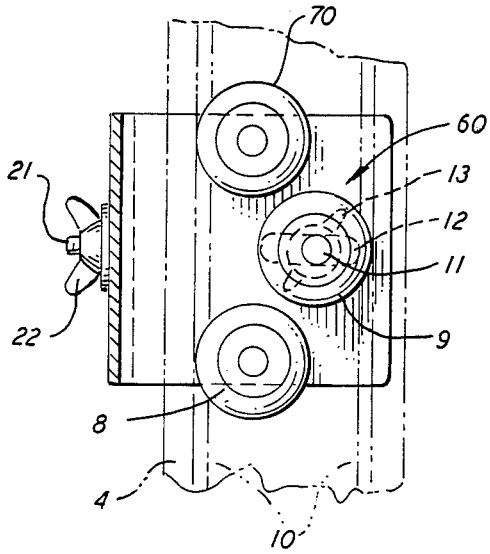
FIG. 3 is an inverse plan view to an enlarged scale of the carriage and track used to guide and support the cut-off saw used with the apparatus.

The apparatus is provided with a guide and support track 4 which is located beneath the table top 1 to one side of the table top and parallel to one edge 5 of the table top. The track may extend beyond the other edges 60 and 7 of the table top as shown in FIG. 1.

The track is provided with a carriage 6 which is guided and supported by the track so that the carriage can run freely along the length of the track in a motion parallel to the side 5 of the table top. The carriage may take any suitable form but is preferably provided with three wheels 70, 8 and 9 arranged on vertical axles mounted in the carriage. The track is provided with two inwardly facing grooves 10 which are engaged by the wheels of the carriage. Two of the wheels 70 and 8 are mounted to one side of the carriage so that they engage the groove on one side of the track and the third wheel 9 which is located between the wheels 70 and 8 is mounted on the other side of the carriage and engages with the groove on the opposite side of the track. The third wheel 9 is preferably mounted so that its axle 11 is engaged in a transverse slot 12 in the carriage and secured in place by an adjustable clamp such as a wing nut 13. The position of the third wheel 9 can therefore be adjusted towards and away from the other two wheels 70 and 8 to provide correct engagement of the wheels in the grooves of the track and to compensate for any wear which may take place between the wheels and the track. As a further refinement all three wheels can be mounted in transverse slots of the type shown at 12 so that the transverse position of the carriage may be adjusted relative to the table to accurately locate the saw blade relative to a datum point such as the slot 34.

A cantilever arm 43 is provided extending upwardly from the carriage to the said one side 5 of the table top and then transversely across the table top in a horizontal portion 14. The horizontal portion 14 is provided with a mounting clamp 15 adapted to support and hold the body of a cut-off saw 16 provided with a circular blade 17. The saw is held and supported so that it may be moved freely across the surface of the table top in a motion parallel to the direction of the track 4 while supported by the cantilever arm 43,14 which is in turn supported by the carriage 6.

The horizontal portion 14 of the cantilever arm is pivotally attached to the vertical portion by way of a pivot bolt 18 and provided with a stop 19 so that the arm is prevented from pivoting below a horizontal position but so that the arm may be lifted for example to the position shown in broken outline at 20 to lift the saw clear of the table top for positioning of a tile and to enable the saw to be lowered towards the table top in a controlled manner for pocket cutting into the surface of a tile. The height of the cantilever arm may also be adjusted by an adjustable mounting bolt 21 provided with a wing nut 22.

A side portion of the table top 23 is pivotally attached to the fixed table top 1 by way of a pivot hinge 24 and is supported on a removable or tiltable prop 25 which can pivot on a pivot pin 26 on the base 3. When it is desired to bevel cut the edge of a tile the table top portion 23 may be hinged downwardly until the outer end 27 rests on a top 28 when the table top portion 23 is then at an angle of 45 degrees. The tile may then be supported on the tilted portion and cut with the cutting blade 17 at an exact bevelled angle of 45 degrees suitable for use in a corner situation.

The apparatus is also provided with a fence 29 in the form of a raised portion along the edge 7 of the table top so that the edge of a tile to be cut may be placed against the fence to accurately align the tile on the table top. Where it is necessary to angle cut tiles a movable fence 30 in the form of a triangular set square is provided mounted on an adjustable arm 31 by way of a wing nut 32 so that the edge 33 of the set square may be positioned at the desired angle to guide the orientation of the tile.

It is a feature of the apparatus that the height of the saw may be positioned using the adjustable bolt and wing nut 21, 22 and the position across the table may be adjusted by moving the saw inside the clamp sleeve 15. In this manner the blade 17 may be accurately positioned in the slot 34 between the two parts of the table top and the location of the tile may be accurately determined using indicia mounted on the upper face of the fence 29. Once the tile is placed in position the saw is actuated and provided with cooling water through a water supply hose 35. The operator then grasps the handle 36 of the saw and pushes the saw across the table top through the tile accurately guided by the carriage 6 moving in the track 4.

It is a feature of the invention that the track is located in a position where it will not be clogged by grit or cooling water from the saw and is designed so that it is self cleaning, i.e., the open portions of the track face downwardly so that any grit or dirt will fall from the grooves of the track. The portions of the track which protrude beyond the edges 6 and 7 of the table are provided with cover plates 37 to keep the track clean.

In this manner tile cutting apparatus is provided which is simple and cheap to manufacture and which enables tiles to be cut extremely accurately and with a neat edge. The apparatus is simple to use as the table top is not impeded with supports for the saw and furthermore the saw may be readily tilted upwardly out of the way to enable simple and accurate positioning of the tile on the table top. From the elevated position the saw may be lowered to an accurately predetermined position by tilting the saw downwardly about the pivot bolt 18.

I claim:

1. Tile cutting apparatus comprising:

a work table adapted to support a tile to be cut, a guide and support track located adjacent and parallel to one side of the top of the work table, a carriage guided and supported by the track, and a cantilever arm adapted to support a cut-off saw at a predetermined height above the table, said cantilever arm including (i) a vertical portion extending from the carriage upwardly to said one side of the table, and (ii) a horizontal portion extending transversely above the table, and pivotally connected to the vertical portion so that the horizontal portion and hence the cut-off saw may be tilted upwardly away from the table top and then lowered downwardly for pocket cutting into the surface of the tile.

2. Tile cutting apparatus as claimed in claim 1 wherein said track is located beneath the top of the work table adjacent an edge thereof, and the track longitudinally extends parallel to said edge.

3. Tile cutting apparatus as claimed in either claim 1 or claim 2 wherein:

said track comprises two mutually opposed, sideways facing first and second grooves, and the carriage includes a plurality of wheels engaging the grooves.

4. Tile cutting apparatus as claimed in claim 3 wherein:

said plurality of wheels includes first, second and third wheels each running on a vertical axle, the first and second wheels are spaced apart and engage the first groove, and the third wheel is located between said first and second wheels and engages the second groove.

5. Tile cutting apparatus as claimed in claims 1 or 2 wherein the height of said vertical portion of the cantilever arm is adjustable to adjust the height of the cut-off saw above the table top.

6. Tile cutting apparatus comprising:

a work table adapted to support a tile to be cut;

a guide and support track located adjacent and parallel to one side of the top of the work table, and including mutually opposed, sideways facing first and second grooves;

a carriage guided and supported by the track, and including first, second and third wheels each running on a vertical axis, and wherein (i) the first and second wheels are spaced apart and engaged in the first groove, and (ii) the third wheel is located between the first and second wheel and engaged in the second groove; and a cantilever arm adapted to support a cut-off saw at a predetermined height above the table, said cantilever arm extending from the carriage upwardly to said one side of the table and then transversely thereabove.

7. Tile cutting apparatus as claimed in claim 6 wherein the third wheel is mounted on an axle adjustable towards and away from a line through the first and second wheels to compensate for wear in the track or wheels.

8. Tile cutting apparatus as claimed in claim 6 wherein the first and second wheels are mounted on axles adjustable towards and away from a line through the third wheel, parallel to the track, to allow lateral adjustment of the carriage with respect to the track.

9. Tile cutting apparatus as claimed in claim 6 wherein the cantilever arm includes a vertical portion extending upwardly from the carriage, said vertical portion having an adjustable height to vary the height of the cut-off saw above the table top.

10. Tile cutting apparatus as claimed in claim 9 wherein the cantilever arm further includes a horizontal portion extending transversely above the table, and pivotally connected to the vertical portion so that the horizontal portion and hence the cut-off saw may be tilted upwardly away from the table top and then lowered downwardly to form pocket cuts in the tile.

11. Tile cutting apparatus as claimed in claim 6 wherein said third wheel is mounted on an axle adjustable towards and away from a line through the first and second wheels to compensate for any wear in the track or wheels.

12. Tile cutting apparatus as claimed in claim 11 wherein said first and second wheels are mounted on axles adjustable towards and away from a line through the third wheel, parallel to the track, to allow lateral adjustment of the carriage with respect to the track.

13. Tile cutting apparatus as claimed in claim 1, 2 or 6 wherein the table top includes:

a fixed level section and a pivotal section pivotally connected to the fixed level section by at least one pin, and pivotal downwardly to a predetermined angle relative to the fixed level section to cut a tile, placed on and supported by the pivotal section, with the cut-off saw at said predetermined angle.

14. Tile cutting apparatus as claimed in claims 1, 2 or 6 wherein the table top includes:

a fixed raised edge to align the tile on the table top in a fixed angular position; and an adjustable raised edge to align the tile on the table top in a plurality of different angular positions and to enable tiles to be cut in said different angular positions.

* * * * *